US008291666B1

(12) United States Patent
Garrison

(10) Patent No.: US 8,291,666 B1
(45) Date of Patent: Oct. 23, 2012

(54) DECKING PANEL SYSTEM

(75) Inventor: Dondi D. Garrison, Cullman, AL (US)

(73) Assignee: Flotation Systems, Inc., Cullman, AL (US)

( * ) Notice: Subject to any disclaimer, the term of this patent is extended or adjusted under 35 U.S.C. 154(b) by 25 days.

(21) Appl. No.: 12/713,845

(22) Filed: Feb. 26, 2010

Related U.S. Application Data

(60) Provisional application No. 61/155,594, filed on Feb. 26, 2009.

(51) Int. Cl.
*E04B 5/12* (2006.01)
*E04B 5/14* (2006.01)

(52) U.S. Cl. ..... 52/489.1; 52/483.1; 52/177; 52/181; 52/745.05

(58) Field of Classification Search ..... 52/650.3, 52/480, 483.1, 177, 181, 489.1, 585.1, 586.1, 52/745.05, 745.06, 745.02; 403/388, 384, 403/400, 286
See application file for complete search history.

(56) References Cited

U.S. PATENT DOCUMENTS

| | | | | | |
|---|---|---|---|---|---|
| 1,699,074 | A | | 1/1929 | Loucks | |
| 1,889,770 | A | | 12/1932 | Black | |
| 2,070,839 | A | * | 2/1937 | Place | 52/177 |
| 2,362,252 | A | * | 11/1944 | Ellinwood | 52/288.1 |
| 4,603,528 | A | * | 8/1986 | Sigerist | 52/464 |
| 5,033,147 | A | * | 7/1991 | Svensson | 14/73 |
| 5,394,667 | A | | 3/1995 | Nystrom | |
| 5,660,016 | A | * | 8/1997 | Erwin et al. | 52/483.1 |
| 5,850,720 | A | * | 12/1998 | Willis | 52/650.3 |
| 5,950,377 | A | * | 9/1999 | Yoder | 52/177 |
| 6,314,699 | B1 | * | 11/2001 | West | 52/489.1 |
| 6,402,415 | B1 | * | 6/2002 | Eberle, III | 403/231 |
| 6,470,641 | B1 | * | 10/2002 | Faure | 52/480 |
| 6,484,467 | B2 | * | 11/2002 | Crout | 52/483.1 |
| 6,637,163 | B2 | * | 10/2003 | Thibault et al. | 52/177 |
| 6,651,398 | B2 | * | 11/2003 | Gregori | 52/489.1 |
| 6,694,691 | B2 | * | 2/2004 | Ku | 52/403.1 |
| 6,711,864 | B2 | | 3/2004 | Erwin | |
| 6,810,633 | B2 | | 11/2004 | Harris, Sr. | |
| 6,871,467 | B2 | * | 3/2005 | Hafner | 52/586.1 |
| D522,147 | S | | 5/2006 | Morton et al. | |
| 7,409,803 | B2 | | 8/2008 | Grohman | |
| 7,533,500 | B2 | * | 5/2009 | Morton et al. | 52/177 |
| 2002/0059766 | A1 | * | 5/2002 | Gregori | 52/489.1 |
| 2002/0121064 | A1 | * | 9/2002 | Erwin | 52/586.1 |
| 2004/0040244 | A1 | | 3/2004 | Baker | |
| 2004/0079041 | A1 | * | 4/2004 | Bergeron et al. | 52/489.1 |
| 2005/0028469 | A1 | * | 2/2005 | Grohman | 52/480 |
| 2006/0059822 | A1 | | 3/2006 | Guffey | |
| 2006/0283122 | A1 | * | 12/2006 | Burgess et al. | 52/480 |

OTHER PUBLICATIONS

Versadeck Aluminum Plank Decking—Unique Extruded Combineable Design, found at http://www.versadeck.com/products/versa_plank.php, © 2007, 2 pages. Versadeck Versaplank R-40 Plank Aluminum Decking System Installation Instructions, Care & Cleaning and Warranty, © 2007-2008, Versadeck Decking, Inc., 8 pages.

* cited by examiner

*Primary Examiner* — Phi Dieu Tran A
(74) *Attorney, Agent, or Firm* — Angela Holt; Bradley Arant Boult & Cummings LLP

(57) ABSTRACT

A decking system comprised of decking panels and clips is provided. Each decking panels comprises a platform and downwardly-extending legs that rest on joists. Clips that clip onto the joists are inserted between adjacent decking panels and define a uniform gap between the panels. The clips further connect to the legs of the decking panels and hold the decking panels in place. Fasteners driven through the clips and into the joists rigidly affix the decking panels to the joists.

14 Claims, 7 Drawing Sheets

DECKING PANEL SYSTEM

RELATED APPLICATIONS

This application is a continuation of and claims priority to U.S. provisional Application Ser. No. 61/155,594, filed Feb. 26, 2009, titled "Decking Panel System," which is incorporated herein by reference.

BACKGROUND & SUMMARY

A decking system comprised of extruded decking panels is provided. A clip attached to a joist receives and retains the outer legs of adjacent decking panels. The clip comprises downwardly-extending legs that grip the sides of the joist and hold the clip in place until a fastener is installed in the clip to permanently attach the clip and the decking panels to the joist. The clips allow an entire deck surface, or portions of the deck surface, to be set in place before the permanent fasteners are installed.

BRIEF DESCRIPTION OF THE DRAWINGS

The present invention is described with reference to the accompanying drawings. In the drawings, like reference numbers indicate identical or functionally similar elements.

DETAILED DESCRIPTION

Figure 1:
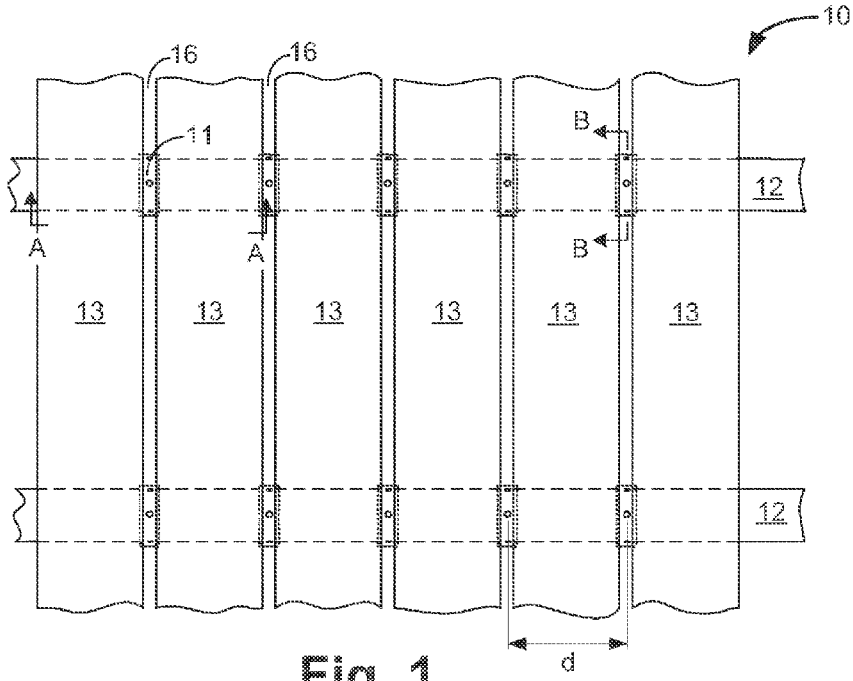
FIG. 1 depicts a decking system according to an embodiment of the present disclosure.

The present invention and its advantages are best understood by referring to the drawings. The elements of the drawings are not necessarily to scale, emphasis instead being placed upon clearly illustrating the principles of the invention.

FIG. 1 shows a decking system 10 according to one embodiment of the present disclosure. The decking system 10 includes a plurality of substantially identical decking panels 13 disposed upon a plurality of joists 12. Clips 11 clipped to the joists 12 secure the decking panels 13 to the joists 12 via fasteners (not shown) installed into the clips 11. The clips 11 further set the spacing of gaps 16 between the decking panels 13, as is further discussed herein.

The joists 12 are typically fabricated from wood. In one embodiment, the decking panels 13 are extruded aluminum, though in other embodiments may be fabricated from other materials known in the art or hereafter developed, such as composite, other metals, plastic, or the like. In one embodiment, the decking panels 13 have a wall thickness of 0.065 inches. The decking panels 13 are generally rectangular and may be made in any length desired by a user (not shown), and in one embodiment are formed in lengths of 12, 16 and 20 feet.

The width of a decking panel according to one embodiment is 5¾ inches, though other widths may be used in other embodiments. The distance "d" from the center of one clip 11 to the center of an adjacent clip 11 is 6" in one embodiment, though other distances may be employed in other embodiments.

In the illustrated embodiment, the decking panels 13 are disposed generally perpendicularly to the joists 12. In other embodiments, the decking panels 13 may be differently angled relative to the joists 12.

Figure 2:
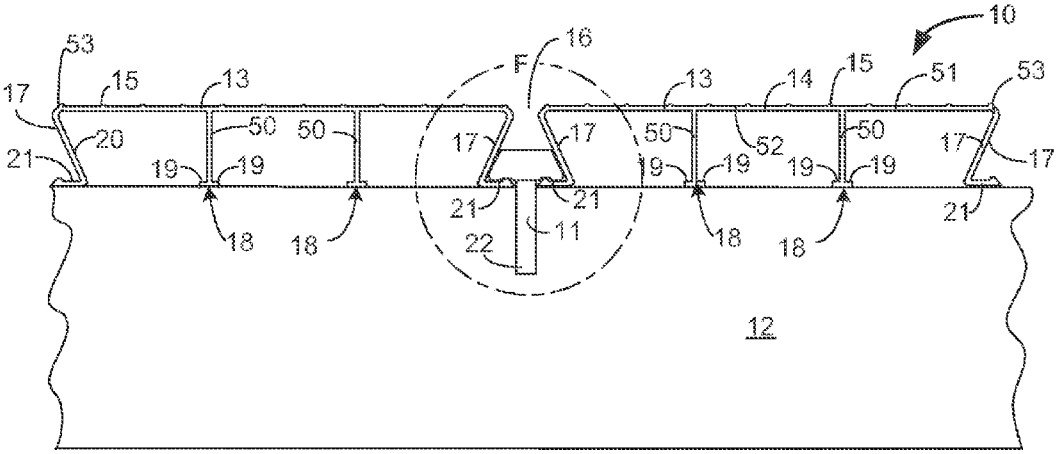
FIG. 2 is a cross-sectional view of the decking system of FIG. 1, taken along section lines A-A of FIG. 1.

FIG. 2 is a cross-sectional view of the decking system 10 of FIG. 1, taken along section lines A-A of FIG. 1. In this embodiment, each decking panel 13 comprises an extruded aluminum platform 51. The platform 51 is generally horizontal and comprises a top panel surface 14 which forms a walking surface of the decking system 10.

The top panel surface 14 of the platform 51 comprises protrusions 15 that are raised areas unitarily formed with the platform 51. The protrusions 15 provide texture to the top panel surface 14 and therefore provide traction for the user (not shown) of the decking system 10. The protrusions 15 generally run longitudinally down the length of the platform 51.

The decking panels 13 further comprise outer legs 17 and inner legs 18. The outer legs 17 and the inner legs 18 extend downwardly from and support the platform 51 spaced apart from (i.e. raised above) the joists 12. The outer legs 17 and the inner legs 18 extend longitudinally down the length of the decking panels 13 in this embodiment.

The inner legs 18 comprise generally vertical supports 50 extending generally perpendicularly down from a bottom side 52 of the platform 51. The inner legs 18 further comprise lower side flanges 19 that extend from the generally vertical supports 50 and rest on the joists 12. The outer legs 17 comprise an angled portion 20 that extends downwardly from an outer edge 53 of the platform 51 and a generally horizontal portion 21 connected to the angled portion 20. The outer legs 17 thus form a "Z"-shape in conjunction with the platform 51. In other embodiments, the outer legs 17 of the decking panels 13 are differently shaped, as is further discussed herein.

Each clip 11 has two (2) downwardly-extending legs 22 (one of which is shown in FIG. 2) that frictionally grip opposite sides of the joist 12 to hold the clip 11 to the joist 12 until a fastener (not shown) is installed through the clip into the joist, as further discussed herein.

The decking panels 13 are spaced apart from one another by the gap 16 between the panels 13. The gap 16 is maintained generally uniformly by the clip 11 which fits between the outer legs 17 of adjacent decking panels 13, as shown. When installed, the clip 11 contacts the outer legs 17 of adjacent decking panels 13 such that when the fastener (not shown) is installed, the clip 11 secures the decking panels 13 firmly in place against the joist 12, as further discussed herein.

Figure 3:
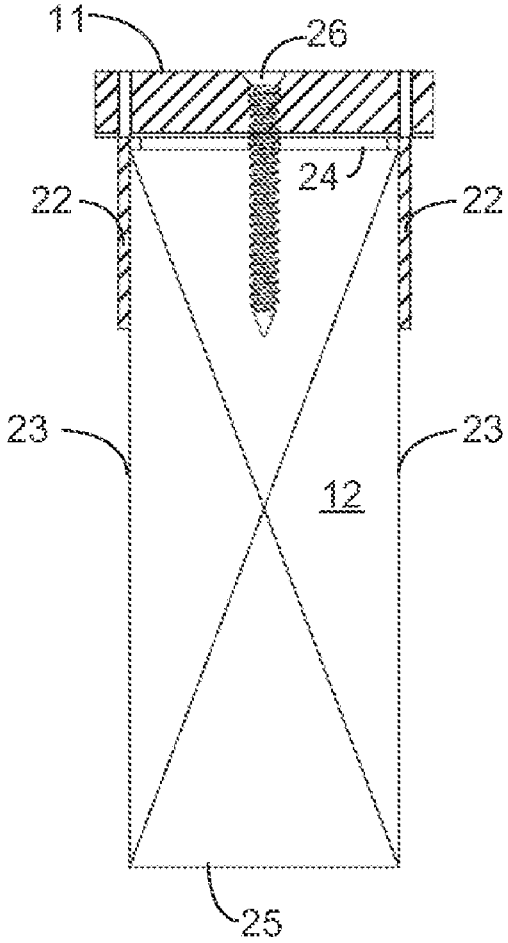
FIG. 3 is a cross-sectional view of the decking system of FIG. 1, taken along section lines B-B of FIG. 1.

FIG. 3 is a cross-sectional view of the clip 11 of FIG. 1, taken along section lines B-B of FIG. 1. The joist 12 has a generally rectangular cross-section in this embodiment, with two generally-straight long sides 23 and a generally straight top and bottom side, 24 and 25, respectively, that are disposed generally perpendicularly to the long sides 23. The clip 11 fits over the top short side 24 such that the downwardly-extending legs 22 of the clip 11 extend partially down the long sides 23, as shown. After the clip 11 is installed on the joist 12, a fastener 26 is installed in the clip 11 and driven into the joist 12 to secure the clip to the joist 12.

The fastener 26 may be a typical threaded wood screw that is self-tapping when driven into the joist 12. In other embodiments, other types of fasteners may be used.

Figure 4:
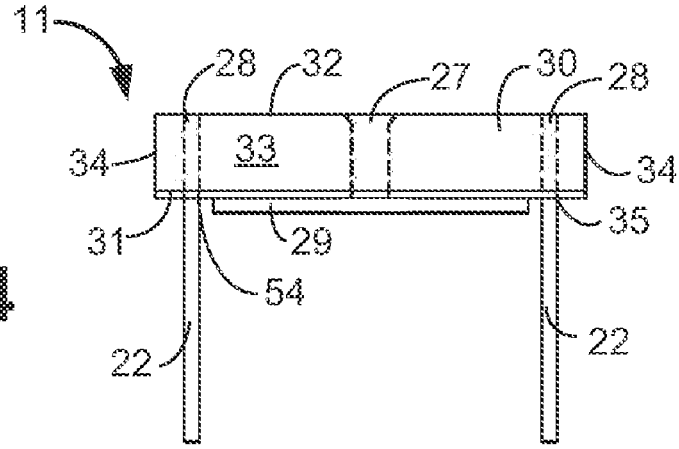
FIG. 4 is a side plan view of a clip according to an embodiment of the present disclosure.

FIG. 4 is an enlarged side view of the clip 11 of FIG. 1. In this embodiment, the clip 11 comprises an elongated clip body 30, a top side 32, two (2) angled side edges 33 (only one of which is shown in FIG. 4), two (2) ends 34, and a bottom side 31. The downwardly-extending legs 22 extend generally perpendicularly from the bottom side 31 of the clip body 30. The legs 22 are disposed near the ends 34 of the clip body 30, as shown.

One or more raised tracks 29 are disposed on the bottom side 31 of the clip body 30. The raised tracks 29 comprise elongated pointed protrusions integrally formed with the clip body 30. The tracks 29 "dig into" or grasp the joist 12 (FIG. 3) when the fastener 26 (FIG. 3) secures the clip 11 to the joist 12. In this regard, the joist 12 is generally formed of wood that is penetrable by sharp or pointed objects. The tracks 29 may thus penetrate the joist 12 and help to secure the clip 11 to the joist 12.

In this embodiment, the clip body 30, the legs 22, and the tracks 29 are integrally formed from a solid material, such as by injection molding of plastic. In other embodiments, other materials and/or processes currently known or hereafter developed may be used to fabricate the clip 11.

A fastener opening 27 in the clip body 30 extends through the clip body 30 and receives the fastener 26 (FIG. 3). The fastener opening 27 may be a countersunk hole such that when the fastener 26 is installed, the fastener 26 does not protrude above the clip body 30. Other configurations of openings 27 are usable with other types of fasteners 26 that may be used in other embodiments to attach the clip 11 to the joist 12.

In the illustrated embodiment, the fastener opening 27 is centrally located within the body 30 (i.e., located equidistant from the ends 34 and the angled side edges 33). In other embodiments, the fastener opening 27 may be located elsewhere on the clip 11.

The illustrated embodiment includes leg openings 28 disposed above each of the downwardly-extending legs 22. The leg openings 28 comprise hollow rectangular channels formed in the body 30 directly adjacent to (i.e., above) the legs 22. The purpose of the leg openings 28 is to provide "weak spots" 54 at the juncture of the body 30 and a top end 35 of the legs 22. These weak spots 54 enable the legs 22 to be readily broken off in the event the user (not shown) desires to use the clip 11 in a configuration where there is no access for the legs 22 to clamp onto the joist 12. Breaking off one or more legs 22 may be desired, for example, if there are two joists 12 abutted directly together.

Figure 5:
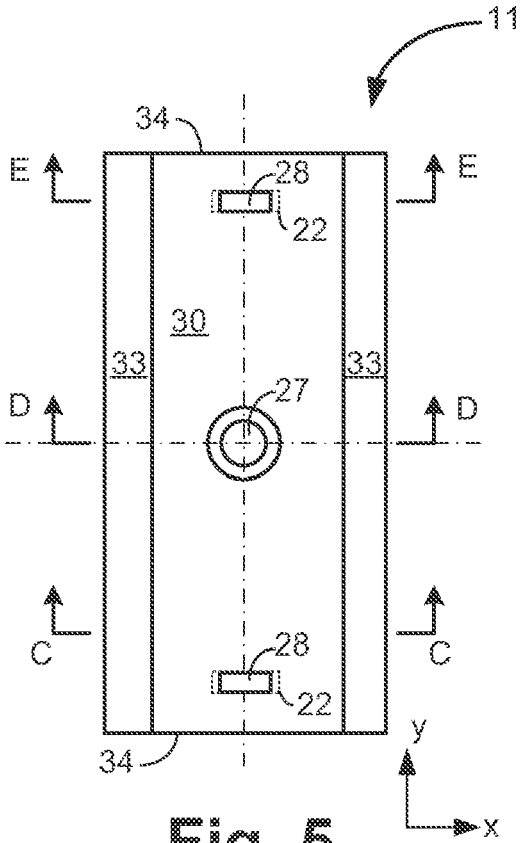
FIG. 5 is a top plan view of the clip of FIG. 4.

FIG. 5 is a top plan view of the clip 11 of FIG. 4. The body 30 approximates a rectangle when viewed from the top, as shown. The fastener opening 27 is centrally located in this embodiment, as discussed above with respect to FIG. 4. The leg openings 28 comprise rectangularly-shaped channels that extend into the body 30. The clip 11 is substantially symmetrical around its x and y axes in this embodiment, as illustrated.

Figure 6:
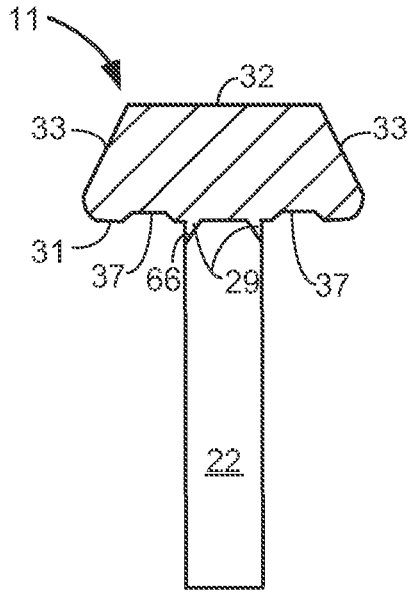
FIG. 6 is a cross-sectional view of the clip of FIG. 5, taken along section lines C-C of FIG. 5.

FIG. 6 is a cross-sectional view of the clip 11 of FIG. 5, taken along section lines C-C of FIG. 5. In this embodiment, the raised tracks 29 comprise a pair of protrusions that extend along the bottom side 31 of the body 30, and are integrally formed with the body 30. The tips 66 of the tracks 29 narrow (i.e., are somewhat sharpened) such that the tips 66 may grip the surface of the joist 12 (FIG. 2).

In this embodiment, the bottom side 31 of the clip body 30 further comprises a pair of channels 37. The channels 37 are recessions in the bottom side 31 of the clip body 30 that extend longitudinally down the body 30. The purpose of the channels 37 is to receive and retain the free ends 39 (FIG. 9) of the outer legs 17 (FIG. 2), as is further discussed with respect to FIG. 9 below.

In this embodiment, the side edges 33 angle downward and outward from the top side 32. The angle of the side edges 33 is substantially similar to the angle of the angled portions 20 of the outer legs 17 (FIG. 2). The similarity in angles of the side edges 33 of the clip 11 and the angled portions 20 of the outer legs 17 enables the edges 33 of the clip 11 to snugly abut the angled portions 20 of the outer legs 17, as shown in FIG. 2. In other embodiments, the side edges 33 may be differently shaped to abut differently-shaped outer legs 17.

Further, in other embodiments of the clip 11 the side edges 33 may not contact the decking panels 13 (FIG. 2) at all, but rather the bottom surface 31 of the clip 11 may be the only portion of the clip 11 that contacts the decking panels 13.

Figure 7:
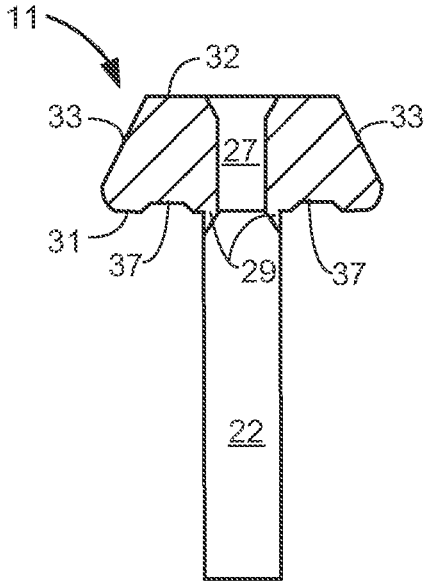
FIG. 7 is a cross-sectional view of the clip of FIG. 5, taken along section lines D-D of FIG. 5.

FIG. 7 is a cross-sectional view of the clip 11 of FIG. 5, taken along section lines D-D (i.e., the centerline) of FIG. 5. The fastener opening 27 as shown extends completely through the clip body 30 from the top side 32 to the bottom side 31, such that the fastener 26 (FIG. 3) can be installed through the opening 27, as was discussed above with respect to FIG. 3.

Figure 8:
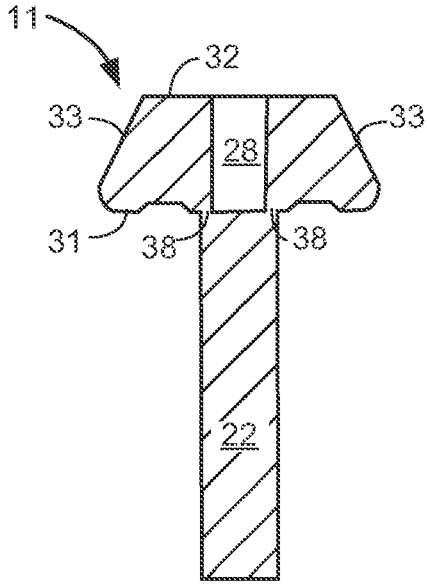
FIG. 8 is a cross-sectional view of the clip of FIG. 5, taken along section lines E-E of FIG. 5.

FIG. 8 is a cross-sectional view of the clip 11 of FIG. 5, taken along section lines E-E of FIG. 5. The leg opening 28 extends most of the way down through the body 30, as shown, such that only thin strips 38 of material attach the leg 22 to the body 30, so that the leg 22 may be broken off of the body 30 as may be desired by the user (not shown).

Figure 9:
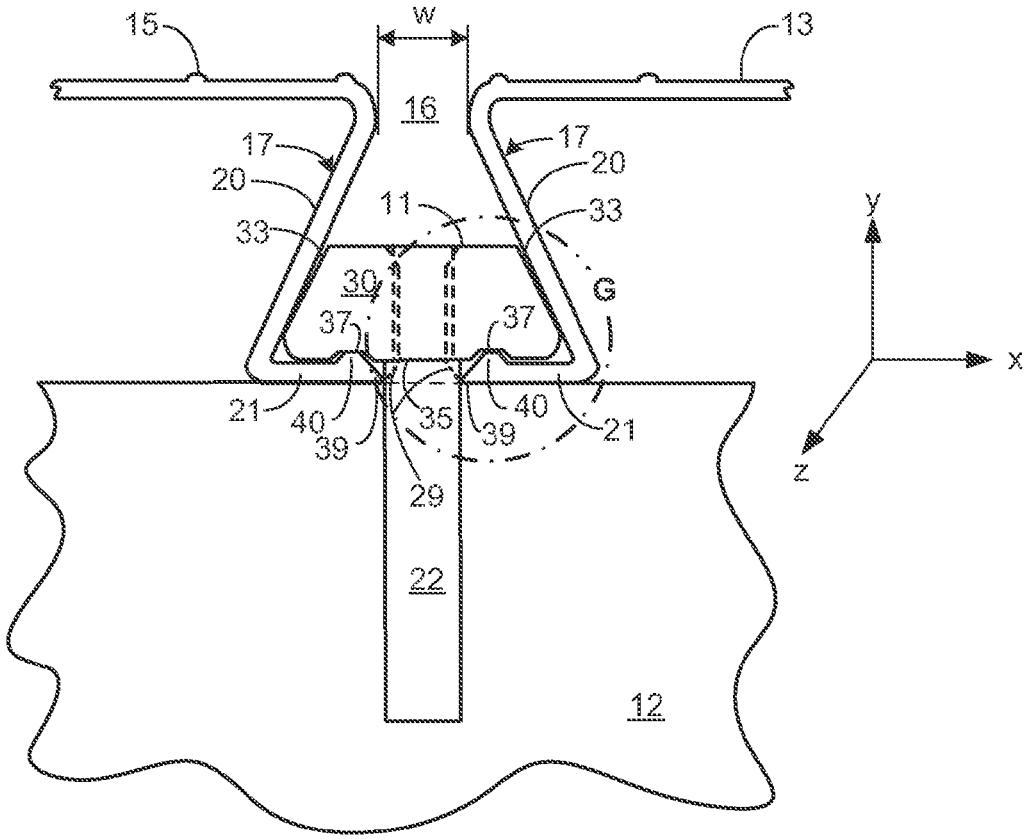
FIG. 9 is an enlarged detail view taken along line "F" of FIG. 2.

FIG. 9 is a detail view of the clip 11 of FIG. 2, taken along detail "F" of FIG. 2. As illustrated, the body 30 of the clip 11 fits within a somewhat trapezoidal area created by the angled portions 20 of the outer legs 17 of adjacent decking panels 13. As was discussed above with respect to FIG. 6, the side edges 33 are disposed at an angle similar to the angle of the angled portions 20, such that the body 30 may fit snugly between the angled portions 20 of adjacent decking panels 13. The side edges 33 fitting snugly within the angled portions 20 of adjacent decking panels 13 prevents the clip 11 from moving with respect to the decking panels 13 in the ±x direction and the ±y direction.

In this embodiment, the body 30 fitting within the angled portions 20 sets the width "w" of the gap 16 between adjacent decking panels 13 and further maintains the uniformity of the gap 16. In one embodiment, the width "w" of the gap 16 comprises approximately ¼ inches. In other embodiments, different widths of the gap 16 may be used.

The free ends 39 of the outer legs 17 comprise protrusions 40 that fit within the channels 37 of the clip body 30. The channels 37 thus receive and retain the free ends 39, and in this manner, the clip 11 retains the decking panels 13 in place, as further discussed herein. The protrusions 40 fitting within the channels 37 further aids in preventing the clip 11 from moving with respect to the decking panels 13 in the ±x direction.

Figure 10:
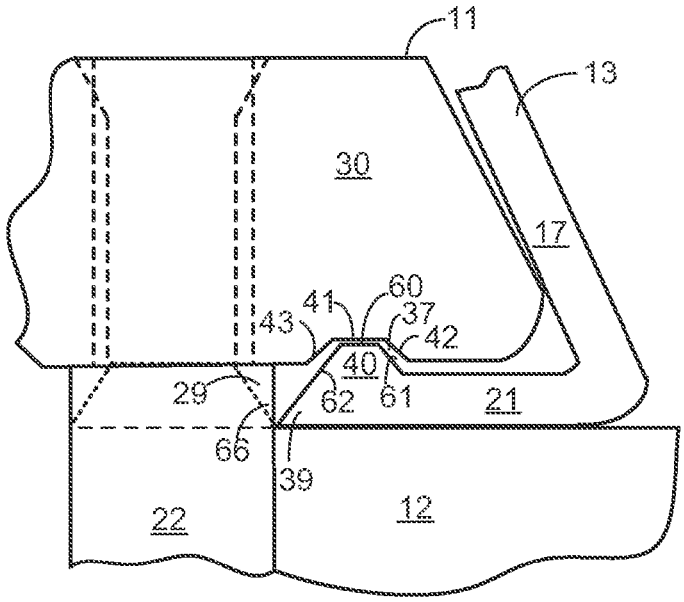
FIG. 10 is an enlarged detail view taken along line "G" of FIG. 9.

The legs 22 of the clip 11 fit in between the free ends 39 of the adjacent decking panels 13. The tracks 29 of the clip 11 also fit between the free ends 39, such that the tracks 29 may grip the joist 12. The tracks 29 gripping the joists 12 further aids in preventing the clip 11 from moving with respect to the decking panels 13 in the ±x direction FIG. 10 is an enlarged detail view of the clip 11 of FIG. 9, taken along detail "G" of FIG. 9. The channel 37 is formed into the body 30 of the clip 11, and in this embodiment comprises a generally flat top wall 41 and angled side walls 42 and 43.

The protrusion 40 is integral with and extends upwardly from the horizontal portion 21 of the outer leg 17, near the free end 39. In this embodiment, the protrusion comprises a generally flat top wall 60 and angled side walls 61 and 62. When the clip 11 is installed onto the decking panel 13, the protrusion 40 is received by the channel 37. In this regard, the flat top wall 60 of the protrusion 40 contacts the flat top wall 41 of the channel 37. The angled side walls 42 and 43 help to retain the protrusion 40 within the channel 37.

Figure 11:
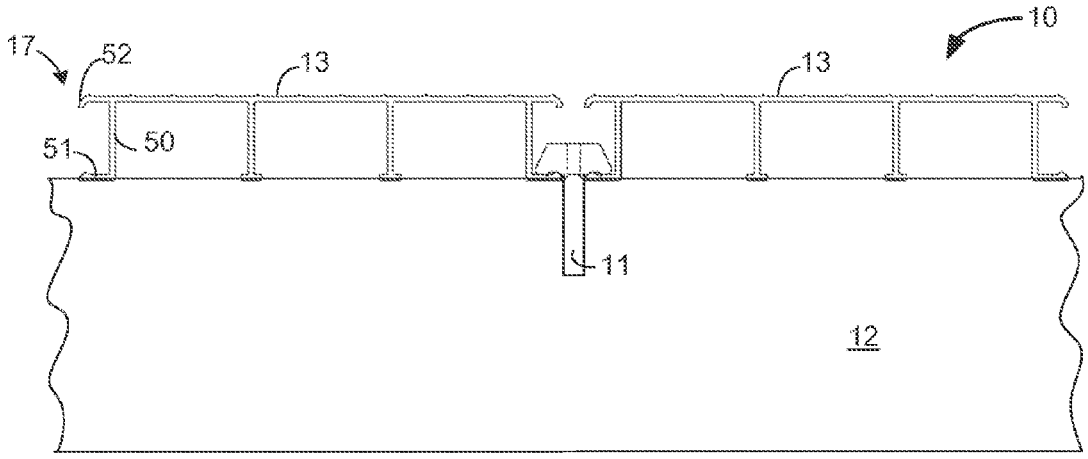
FIG. 11 is a side plan view of the decking system 10 according to an embodiment of the present disclosure.

FIG. 11 illustrates a different embodiment of the decking panels 13. In this embodiment, the outer legs 17 of the decking panels 13 are not Z-shaped as in the prior-discussed embodiment. Rather, the outer legs form an "L"-shape, with a generally vertical portion 50 and a generally horizontal lower end 51. The upper ends 52 of the panel 13 comprise downwardly-curved free ends, as shown.

Figure 12:
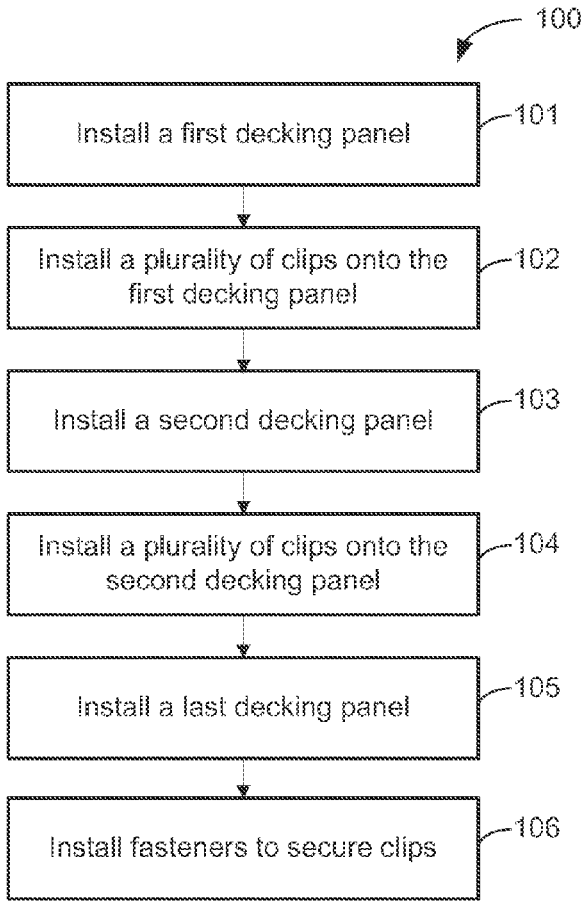
FIG. 12 depicts a method of installing a decking system according to an embodiment of the present disclosure.
Figure 13:
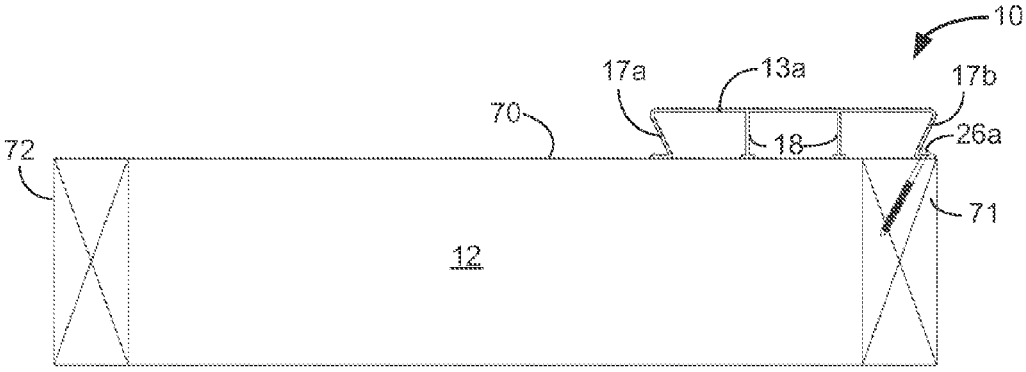
FIG. 13 is a side view of a decking system illustrating a step of the method of FIG. 12, with one a first decking panel installed.

FIG. 12 depicts a method 100 for installing the decking system 10 according to an embodiment of the present disclosure. In step 100, which is illustrated in FIG. 13, a first decking panel 13*a* is installed on a joist 12. Although only one joist 12 is illustrated, it is understood that a plurality of joists 12 are required to support the decking panels 13, as shown in FIG. 1. The joist 12 has a first end 71 and a second end 72. The decking panel 13*a* is disposed upon the joist 12 near the first end 71 such that the outer legs 17*a* and 17*b* and inner legs 18 of the decking panel 13*a* rest upon a top surface 70 of the joist 12.

One or more fasteners 26*a* is driven through the outer leg 17*b*, which is the leg disposed at a first end 71 of the joist 12. The fasteners 26*a* are typically installed at every joist 12 location. Joists 12 are typically located at 12", 18" or 24" centers, though other spacing configurations of joists 12 may be used.

Figure 14:
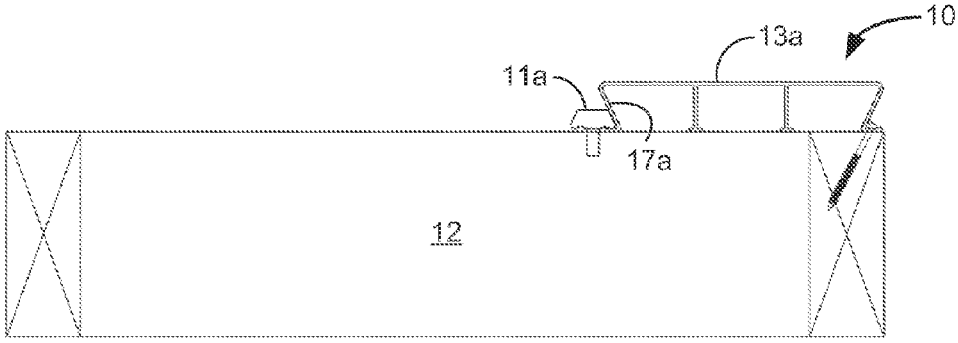
FIG. 14 is a side view of a decking system illustrating a step of the method of FIG. 12, after a plurality of clips is installed to the first decking panel.

In step 102 of the method 100, which is illustrated in FIG. 14, a plurality of clips 11*a* are then clipped on the joists 12 such that the clip(s) 11*a* restrain the outer leg 17*a* of the decking panel 13*a*. Although FIG. 14 shows only one clip 11*a*, there may be a plurality of clips 11*a* used down the length of the panel 13*a*.

Figure 15:
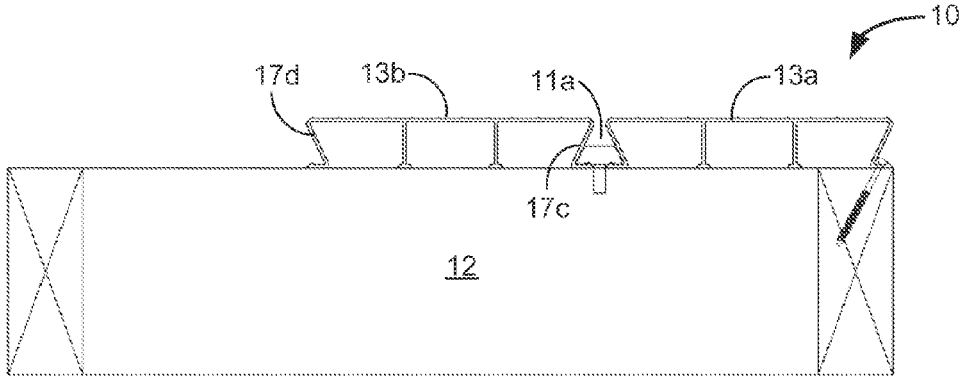
FIG. 15 is a side view of a decking system illustrating a step of the method of FIG. 12, after a second decking panel is installed.

In step 103 of the method 100, which is illustrated in FIG. 15, a second decking panel 13*b* is set on the joist 12. The outer leg 17*c* of the second decking panel 13*b* is slid underneath the clip 11*a*.

Figure 16:
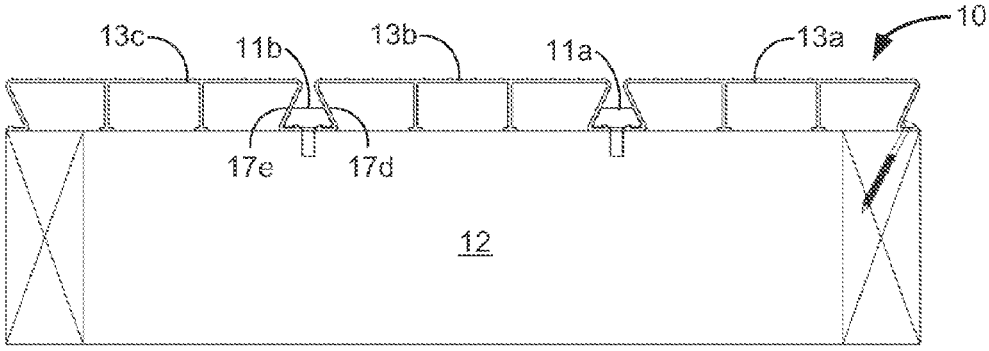
FIG. 16 is a side view of a decking system illustrating a step of the method of FIG. 12, after a third decking panel is installed

In step 104 of the method 100, which is illustrated in FIG. 16, a plurality of clips 11*b* are then installed on the joists 12 such that the clip(s) 11*b* restrain the outer leg 17*d* of the decking panel 13*b*.

In step 105 of the method 100, which is illustrated in FIG. 16, a third decking panel 13*c* is set upon the joists 12 and an outer leg 17*e* of the third decking panel 13*c* is slid underneath the clip 11*b*, as shown.

Figure 17:
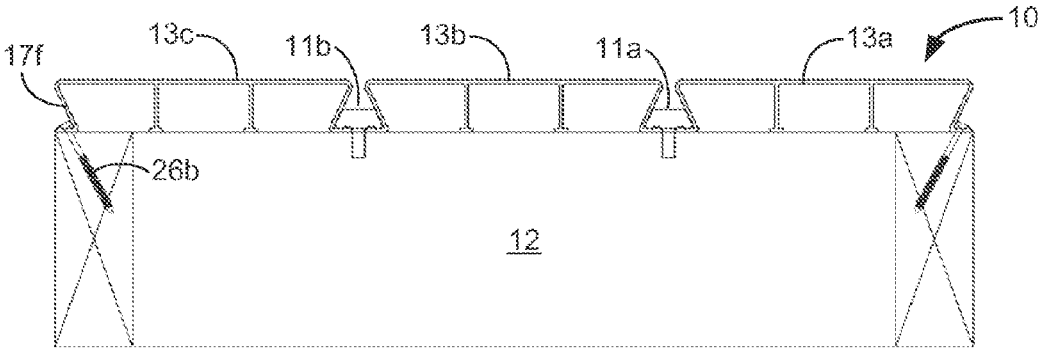
FIG. 17 is a side view of a decking system illustrating a step of the method of FIG. 12, after fasteners are installed in the third decking panel.

Referring to FIG. 17, in the illustrated embodiment, the third decking panel 13*c* is the last decking panel, and after it is in place, one or more fasteners 26*b* are installed in an outer leg 17*f* of the panel 13*c* to secure the panel 13*c* in place.

Figure 18:
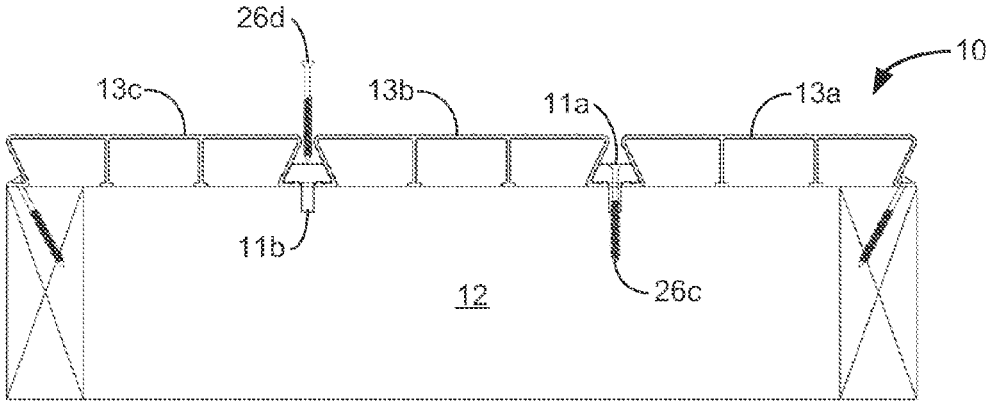
FIG. 18 is a side view of a decking system illustrating a step of the method of FIG. 12, after fasteners are installed into the clips.

In step 106 of the method 100, which is illustrated in FIG. 18, fasteners 26*c* and 26*d* may be installed in the clips 11*a* and 11*b* to permanently secure the decking panels 13*a*, 13*b*, and 13*c* in place.

Although the method 100 and the accompanying FIGS. 13-18 illustrate a decking system 10 comprising three (3) decking panels 13*a*, 13*b*, and 13*c*, it is understood that a deck will generally comprise many more decking panels, which may be installed with the general method discussed herein. Further, although the method 100 and the accompanying FIGS. 13-18 illustrate and two clips 11*a* and 11*b*, it is understood that clips will preferably be installed at every intersection of a decking panel and a joist, and therefore multiple clips will generally be used.

This invention may be provided in other specific forms and embodiments without departing from the essential characteristics as described herein. The embodiment described is to be considered in all aspects as illustrative only and not restrictive in any manner.

The invention claimed is:

1. A decking system, comprising:

a first decking panel adapted for attaching to a joist, the first decking panel comprising a first platform and a first leg, the first leg having a first angled portion extending from the platform and a first horizontal portion, contiguous with the first angled portion, wherein the first horizontal portion rests upon the joist;

a second decking panel adapted for attaching to the joist adjacent to the first decking panel, the second decking panel comprising a second platform and a second leg, the second leg having a second angled portion extending from the second platform and a second horizontal portion, contiguous with the second angled portion, wherein the second horizontal portion rests upon the joist such that when the first decking panel and the second decking panel are adjacently positioned the first leg and the second leg define a space between the first decking panel and the second decking panel; and a clip adapted for insertion in the space between the first decking panel and the second decking panel and for securing the first decking panel and the second decking panel to the joist, the clip comprising a third leg and a fourth leg adapted for frictionally gripping opposing sides of the joist, the clip further comprising a clip body adapted for insertion into the space and attached to the third leg and the fourth leg, the clip body comprising a first angled side edge, a second angled side edge, and a top side, the top side having a first opening therein for receiving a fastener, such that when the clip is attached to the joist the first angled side edge contacts the first angled portion of the first leg and the second angled side edge contacts the second angled portion of the second leg thereby limiting movement of the first decking panel and the second decking panel when the clip is attached to the joist, the clip body further comprising a bottom side comprising a air of raised tracks extending downwardly from the bottom side of the clip body, each raised track comprising a pointed protrusion integrally formed with the clip body and extending along the bottom the clip body, the painted protrusion gripping an upper surface of the joist when the clip is attached to the joist.

2. The decking system of claim 1, wherein the space defined by the first leg and the second leg when the first decking panel is positioned adjacent the second decking panel is trapezoidal.

3. The decking system of claim 1, wherein the first leg and the second leg are Z-shaped.

4. The decking system of claim 1, wherein the third leg and the fourth leg are straight.

5. The decking system of claim 1, wherein the clip body comprises a bottom side having at least one channel extending longitudinally along the bottom side.

6. The decking system of claim 5, wherein the first horizontal portion of the first leg comprises a protrusion that extends upwardly from the first horizontal portion.

7. The decking system of claim 6, wherein when the clip is attached to the joist the channel receives the protrusion thereby limiting movement of the decking panels when the clip is attached.

8. The decking system of claim 5, wherein the channel comprises a substantially flat upper wall and a first angled side wall and a second angled side wall extending downwardly from the flat upper wall.

9. The decking system of claim 8, wherein the first horizontal portion of the first leg comprises a protrusion having a substantially flat top wall and a third angled side wall and a fourth angled side wall extending downwardly from the flat top wall.

10. The decking system of claim 9, wherein when the clip is attached to the joist, the flat top wall abuts the flat upper wall, the third angled side wall abuts the first angled side wall, and the fourth angled side wall abuts the second angled side wall thereby limiting movement of the decking panels.

11. The decking system of claim 1, wherein a top wall of the clip body further comprises a second opening aligned with the third leg such that the third leg may be easily detached from the clip body.

12. The decking system of claim 11, wherein the top wall of the clip body further comprises a third opening aligned with the fourth leg such that the fourth leg may be easily detached from the clip body.

13. A decking system, comprising:

a first decking panel adapted for attaching to a joist, the first decking panel comprising a first platform and a first leg, the first leg having a first angled portion extending from the platform and a first horizontal portion, contiguous with the first angled portion, that rests upon the joist, the first horizontal portion comprising a first protrusion that extends upwardly from the first horizontal portion;

a second decking panel adapted for attaching to the joist adjacent to the first decking panel, the second decking panel comprising a second platform and a second leg, the second leg having a second angled portion extending from the second platform and a second horizontal portion, contiguous with the second angled portion, that rests upon the joist, the second horizontal portion comprising a second protrusion that extends upwardly from the second horizontal portion; and a clip adapted for insertion between the first decking panel and the second decking panel and for securing the first decking panel and the second decking panel to the joist, the clip comprising a first channel and a second channel formed in a bottom side of the clip such that when the clip is attached to the joist, the first channel receives the first protrusion and the second channel receives the second protrusion thereby limiting movement of the first decking panel, a pair of raised tracks extending downwardly from the bottom side of the clip between the first channel and the second channel, each raised track comprising a pointed protrusion integrally formed with the clip and extending along the bottom side of the clip, the pointed protrusion gripping an upper surface of the joist when the clip is attached to the joist.

14. A decking method, comprising:

attaching a first decking panel to a joist, the first decking panel comprising a first platform and a first leg, the first leg having a first angled portion extending from the platform and a first horizontal portion, contiguous with the first angled portion, that rests upon the joist;

sliding opposed legs of a clip over the joist such that the opposed legs frictionally grip opposing sides of the joist and a first angled side edge of a clip body of the clip contacts the first angled portion of the first leg;

sliding a second horizontal portion of a second leg extending from a second platform of a second decking panel beneath a portion of the clip such that the second horizontal portion rests upon the joist and a second angled side edge of the clip contacts a second angled portion of the second leg, the second angled portion contiguous with the second horizontal portion;

inserting a first-fastener into the joist through a first opening that extends through a clip body of the clip such that the first decking panel and the second decking panel are secured to the joist; and tightening the fastener such that a pair of raised tracks extending downwardly from a bottom surface of the clip body of the clip grips a top surface of the joist.

* * * * *